US007000763B2

(12) United States Patent
Selby

(10) Patent No.: US 7,000,763 B2
(45) Date of Patent: Feb. 21, 2006

(54) CONSUMER GOODS RETAIL SALE DISPLAY PACKAGE

(75) Inventor: Ricky W. Selby, Danielson, CT (US)

(73) Assignee: Keeper Corporation, North Windham, CT (US)

( * ) Notice: Subject to any disclaimer, the term of this patent is extended or adjusted under 35 U.S.C. 154(b) by 85 days.

(21) Appl. No.: 10/676,396

(22) Filed: Oct. 1, 2003

(65) Prior Publication Data

US 2005/0072708 A1 Apr. 7, 2005

(51) Int. Cl.
*B65D 73/00* (2006.01)

(52) U.S. Cl. ..... 206/461; 206/471; 206/349

(58) Field of Classification Search ..... 206/461, 206/467, 471, 495, 462, 349, 806; D9/457
See application file for complete search history.

(56) References Cited

U.S. PATENT DOCUMENTS

| | | | | |
|---|---|---|---|---|
| 2,879,886 | A | 3/1959 | Crane | |
| 4,958,731 | A * | 9/1990 | Calcerano | 206/705 |
| 5,168,999 | A | 12/1992 | Lee et al. | |
| 5,560,490 | A * | 10/1996 | Chawla | 206/539 |
| 6,364,115 | B1 * | 4/2002 | Casanova et al. | 206/471 |
| 6,578,711 | B1 * | 6/2003 | Chou | 206/467 |
| 2001/0040115 | A1 * | 11/2001 | Wani et al. | 206/705 |
| 2003/0057126 | A1 * | 3/2003 | Lee | 206/461 |

* cited by examiner

*Primary Examiner*—David T. Fidei
(74) *Attorney, Agent, or Firm*—M. P. Williams

(57) ABSTRACT

A package (6) includes a frame (7) into which product (34–37) is loaded from the back prior to being closed off by a card (8) which adheres to the back of the frame. The frame has openings (20–23) shaped to receive the product, each opening having retainers (50–53) extending forwardly from the edges thereof, each retainer shaped to engage a particular portion (40–42, 45) of the product.

6 Claims, 2 Drawing Sheets

CONSUMER GOODS RETAIL SALE DISPLAY PACKAGE

TECHNICAL FIELD

This invention relates to a package for displaying consumer goods at the point of sale, the front of the package comprising a frame to retain the consumer goods against a cardboard sheet which is applied to the rear of the package, after the consumer goods are loaded into the frame from the rear.

BACKGROUND ART

A common form of packaging of consumer goods is sometimes called a "blister package", in which the front of the package typically has a semi-rigid transparent plastic shell, typically shaped in some fashion to conform at least in part to the shape of the retained consumer goods. The back of such packages may be plastic but typically may be cardboard with product information printed thereon; alternatively, a card may be placed inside of a package having both front and back plastic panels or shells, sometimes called a clamshell package.

Another form of packaging includes using twist ties, elastics or adhesive tape extending forwardly of a rearward panel of some sort to secure the product to such panel. This is done at times with no plastic shell over the product, and at other times with a plastic shell over the product.

A recent trend is to allow some of the product to be touched or moved in order to satisfy purchaser curiosity prior to sale. In such cases, it is necessary to keep the product retained in the package; therefore, simply tying the product to a panel with twist ties is not deemed to be acceptable; but wire harness ties are used.

Packages with shaped shells and panels that must be loaded before being sealed, and packages having numerous parts that must be assembled in order to complete the packaging operation, are expensive in terms of both material and manpower.

DISCLOSURE OF INVENTION

Objects of the invention include: a cheaper product package; a simpler product package; a product package which allows the product to be viewed directly and touched by consumers, which nonetheless adequately retains the product; a package which does not require the insertion of restraints such as twist ties, elastics or tape in order to secure the product; a package which is inexpensive in terms of both material and labor required to load and finish the package; and an improved product package which is attractive and conducive to consumer acceptance.

As used herein, the term "product" means a single item, a plurality of items, each being the same as each other of said plurality of items, or a plurality of items, at least one of which is not the same as at least another one. As used herein, the term "restrain" means to restrict motion to a sufficiently small amount, in any given direction, so as to cause a restrained product to remain contained in a package, properly oriented for intended consumer viewing and handling.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
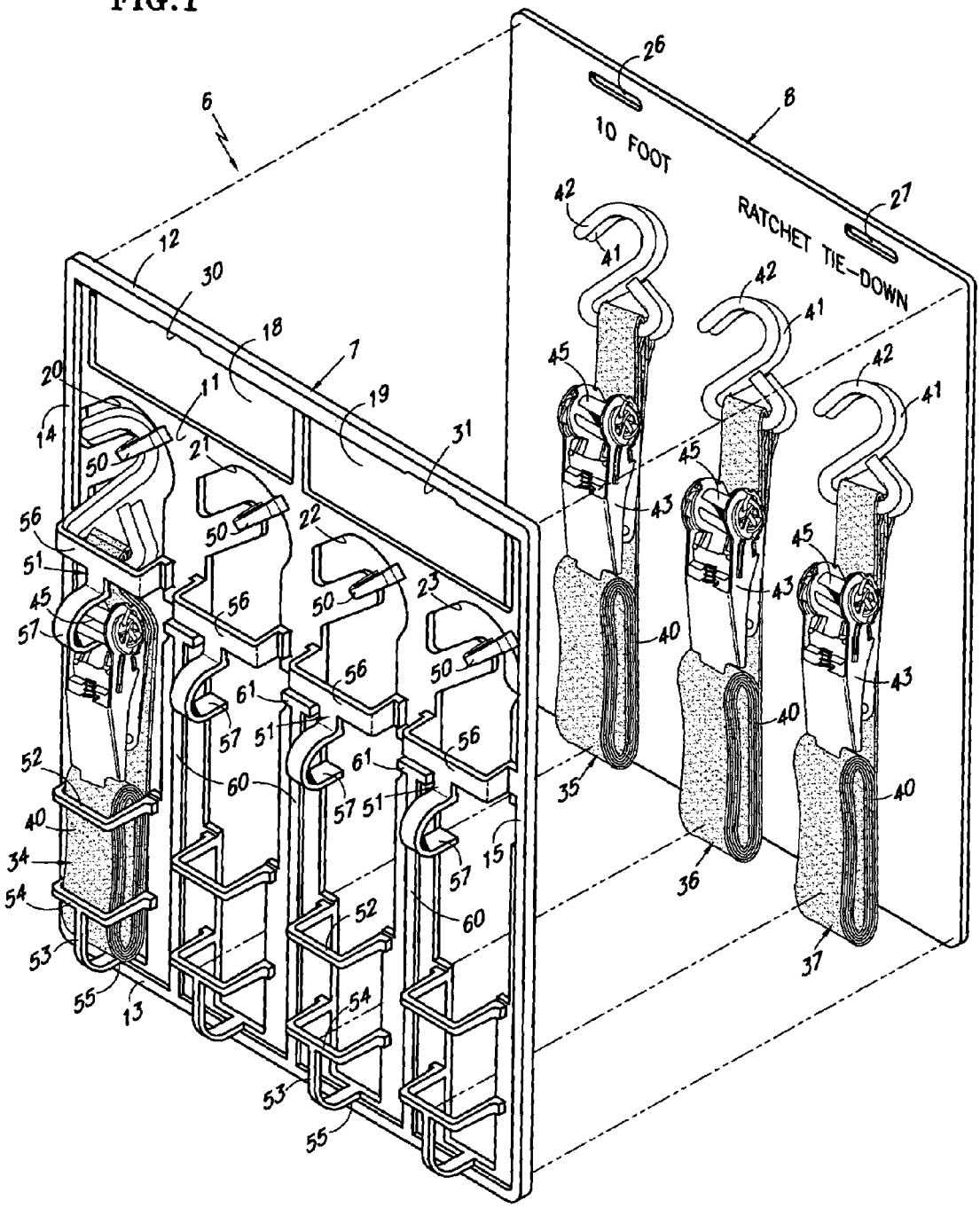
FIG. 1 is an exploded perspective view of product and a package according to the invention.

Referring to FIG. 1, a package 6 according to the present invention includes a frame 7 and a card 8. The card 8 may consist of cardboard, card stock, other cellulose fibrous or plastic sheet material as may be suitable to provide closure to the package by adhering in a suitable manner to the frame 7 and preferably to contain printed product information. The frame has a front face 11, and edges including top 12, bottom 13, right 14 and left 15 edges. The frame 7 has a plurality of openings 18–23 therein. The openings 18, 19 cooperate with openings 26, 27 in the card 8 to permit the packaged product to be disposed on display for retail sale, the openings 18, 19 may have indentations 30, 31 therein, in cooperative relationship with the openings 26, 27, if necessary or desired.

The openings 20–23 are shaped to accommodate the product 34–37, which in the exemplary embodiment herein comprise tie-down straps 40 (but which could be other types of products), each having hooks 41, 42 on one end, and a ratchet buckle 43 for joining the straps 40 under adequate tension to secure a load or the like. The ratchet buckles 43 each have a split axle or drum 45, as is known.

Each of the openings 20–23 has a plurality of retainers 50–53 extending from each of the front side of the edges thereof, each shaped to engage a particular related part of the product 34–37 so as to restrain the product in one or more directions, including up, down, right, left and frontwardly (that is, to the left in FIG. 1 from the face 11 of the frame 7).

The retainer 50 is simply U-shaped and captures the hooks 41, 42 sufficiently to restrain them. The retainer 51 has a bar portion 56 that engages the base of the hooks 41, 42 and a hook portion 57 that engages the drum 45 of the ratchet buckle 43. In FIG. 1, the drum 45 of the ratchet tie-down 34 is not shown fully engaged with the hook portion 57, for clarity.

The retainers 52 are simply U-shaped and serve to hold the upper fold of the straps 40. The retainers 53 have a U-shaped portion 54 similar to the retainers 52 which tends to engage the bottom fold of the straps 40, and a bottom portion 55 which helps to prevent the ratchet tie-downs 34–37 from sliding downwardly out of the package.

A plurality of T-shaped reinforcements extend from the front face 11 of the frame 7. The reinforcements 60 have cross bars 61 which extend to the edges of the corresponding openings 20–23 and serve to support the positioning of the drums 45 in a plane forward of the face 11. However, this is optional, and not an essential part of the present invention.

Figure 2:
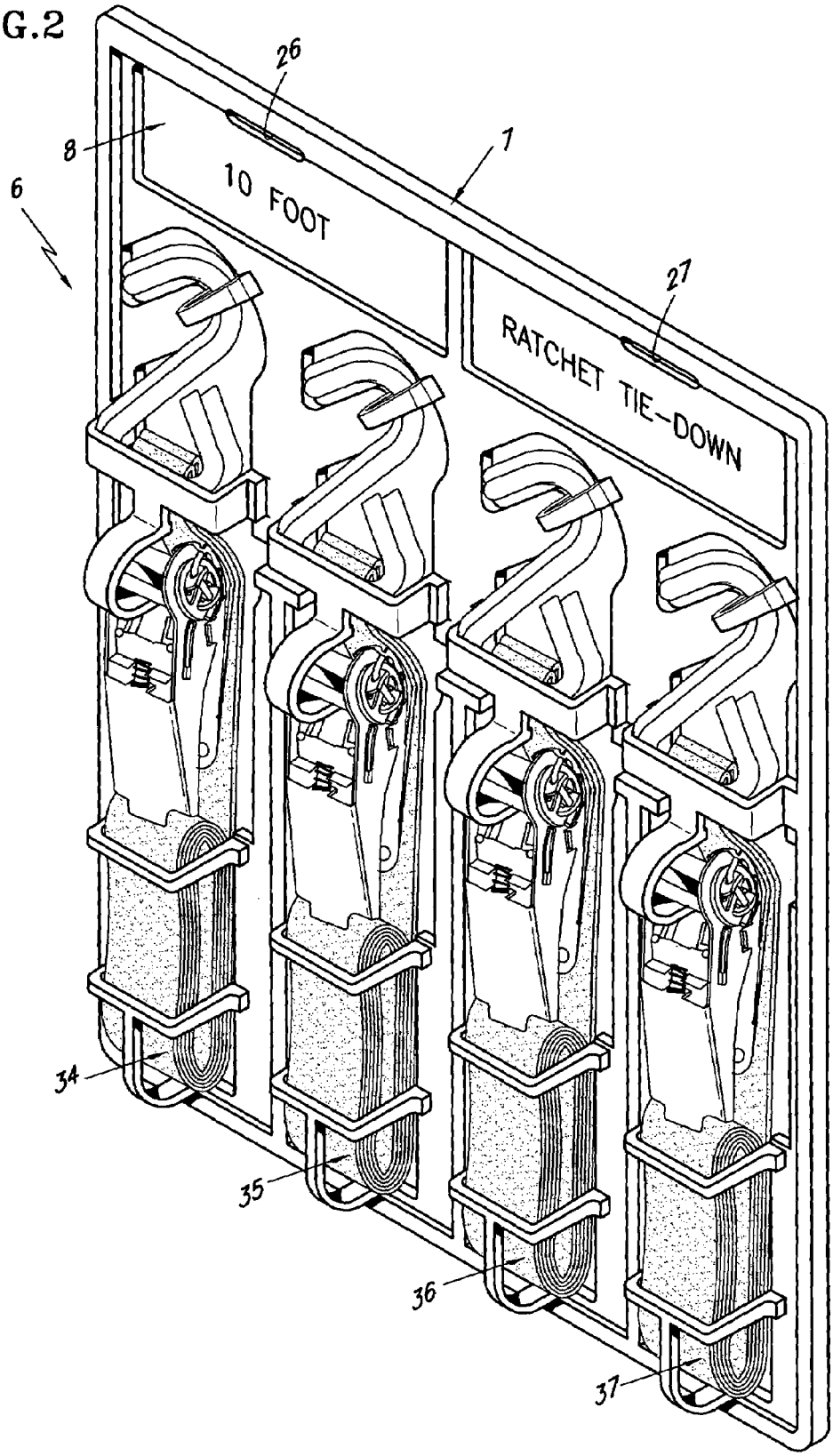
FIG. 2 is a perspective view of a packaged product according to the present invention.

In accordance with the invention, the frame 7 portion of the package according to the invention is loaded from the back as indicated in FIG. 1. When all of the product is in place, then the card 8 can be joined to the rear side of the frame 7 as is illustrated in FIG. 2. The card 8 may consist of card stock, cardboard, other cellulose/fibrous or plastic sheet material as desired, typically capable of having product information printed thereon. The card 8 is fastened to the rear side of the frame 7, preferably by adhesive, but other means such as stapling and edge taping, or if the card is plastic, thermosealing, as well as other methods, may be used if desired to suit any implementation of the present invention.

In the embodiment herein, four products, each identical to the other, are in a single package of the invention. However, the invention may be used to package a single product or other numbers of products, if desired. Further, the present invention may be utilized to package more than one item of product at least one item of product being different from at least one other item of product, if desired. Then, the frame would have openings and retainers for each item.

The nature of the retainers as well as the shapes of the openings will be varied to suit the particular products which are to be retained in place by a frame having openings and retainers and by a card which is fastened to the rear side of such frame, after product is loaded into the frame from the rear (the card side). When the nature of the product permits or requires it, the frame may have more than one opening per item of product being packaged; such would be the case if the product had a thin flat portion that would lie between the frame and the card.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A coverless package for one or more products comprising a frame into which product is loaded from the rear and a card which is fastened to the rear of the frame after the product is loaded therein, comprising:

a frame, said frame, when said package is disposed on display for retail sale with product therein, having a front face intended to be viewed by consumers, having a rear side opposite from said front face and adapted to have a card fastened to said rear side when product is contained in said package, and having top, bottom, left and right edges;

said frame having one or more openings through said frame which are shaped to accommodate receipt therein of said product so that said product can be touched by customers when said package is disposed on display for retail sale with product therein:

said frame having a plurality of retainers, each extending outwardly from said front face adjacent to an edge on each side of each of said one or more openings, each retainer shaped to engage a particular related part of a product so as to restrain said product in one or more of up, down, right, left or forward directions, said retainers together restraining said product within the openings of said frame and in front of said frame and restraining said product from moving away from the front of said frame; and said package including a card to be fastened to the rear side of said frame after product has been inserted from said rear side into and restrained by said openings and said retainers, said card restraining product from rearward movement.

2. A package according to claim 1 wherein there are a plurality of openings, each having retainers extending frontwardly therefrom, thereby to accommodate a plurality of products.

3. A package according to claim 2 wherein each of said openings and corresponding retainers are like each other one of said openings and corresponding retainers.

4. A package according to claim 1 wherein there are four openings, each having retainers extending frontwardly therefrom, thereby to accommodate a plurality of products.

5. A package containing product to be disposed on display for retail sale to consumers, comprising:

one or more items of a product;

a frame, said frame, when said package is disposed on display for retail sale with said product therein, having a front face intended to be viewed by consumers, having a rear side opposite to said front face and adapted to have a card fastened to said rear side with said product contained in said package, and having top, bottom, left and right edges;

said frame having one or more openings through said frame which are shaped to accommodate receipt therein of said product so that said product can be touched by customers when said package is disposed on display for retail sale with said product therein;

said frame having a plurality of retainers, each extending outwardly from said front face adjacent to an edge on each side of each of said one or more openings, each retainer shaped to engage a particular related part of a product so as to restrain said product in one or more of up, down, right, left or forward directions, said retainers together restraining said product within the openings of said frame and in front of said frame and restraining said product from moving away from the front of said frame;

said package including a card fastened to the rear side of said frame with said product inserted within and restrained by said openings and said retainers, said card restraining said product from rearward movement.

6. A package according to claim 5 wherein there are four openings, each having retainers extending frontwardly therefrom, thereby to accommodate a plurality of products.

* * * * *